United States Patent [19]

Murakami

[11] Patent Number: 4,655,575

[45] Date of Patent: Apr. 7, 1987

[54] APPARATUS FOR TRANSPORTING DISC FILMS

[75] Inventor: Motoaki Murakami, Wakayama, Japan

[73] Assignee: Noritsu Kenkyu Center Co., Ltd., Wakayama, Japan

[21] Appl. No.: 841,772

[22] Filed: Mar. 20, 1986

[30] Foreign Application Priority Data

Mar. 26, 1985 [JP] Japan ..... 60-42379[U]

[51] Int. Cl.[4] ..... G03D 3/08

[52] U.S. Cl. ..... 354/322; 354/330

[58] Field of Search ..... 354/322, 329, 330

[56] References Cited

U.S. PATENT DOCUMENTS

| | | | |
|---|---|---|---|
| 4,112,452 | 9/1978 | Patton | 354/322 |
| 4,429,980 | 2/1984 | Miller | 354/330 |
| 4,502,772 | 3/1985 | Mihara | 354/330 |

*Primary Examiner*—A. A. Mathews

*Attorney, Agent, or Firm*—Larson and Taylor

[57] ABSTRACT

An improved apparatus for transporting disc films in a developing apparatus which includes a series of treatment liquid baths. The apparatus includes a support block by means of which a movable rail is supported so as to allow a hanger to slide therealong. The hanger is provided with a rotational shaft at the lower end thereof on which a plurality of disc films to be treated are carried. The support block is adapted to slide along a shaft which extends in parallel with the direction of transportation of the hanger and moreover it is adapted to turn about the shaft. The apparatus further includes a chain-sprocket mechanism which is operatively associated with the support block via a connecting rod and a moving member. During upward movement and lowering movement of the moving member the support block is caused to turn forwardly and backwardly whereby the disc films carried on the hanger are introduced into treatment liquid and removed therefrom. During forward movement of the moving member the hanger is transported to the next operative position located above the next treatment liquid bath while the disc films are raised up above the treatment liquid bath. During backward movement of the moving member a stopper becomes effective for allowing only the movable rail to move back while the disc films are kept to be immersed in treatment liquid in the next treatment liquid bath.

9 Claims, 5 Drawing Figures

APPARATUS FOR TRANSPORTING DISC FILMS

BACKGROUND OF THE INVENTION

1. Field of the Invention

The present invention relates to an apparatus for transporting disc-shaped photographic films that are called disc films, the apparatus being to be assembled in an apparatus for treating photosensitive material, more particularly in a developing apparatus for disc films.

2. Description of the Prior Art

As is well known for any expert in the art, the disc film developing apparatus is constituted by the combination of a dark box, a series of treatment liquid baths in which a plurality of steps of developing, bleaching, fixing and film stabilizing and hardening are carried out with a step of water washing interposed between the adjacent treating steps as required and a disc film transporting apparatus for successively immersing disc films into the treatment liquid baths in the substantially same manner as in the case of a conventional developing apparatus for photographically treating a long length of photographic film.

As to the conventional disc film transporting apparatus by means of which a plurality of movements comprising raising and lowering movement for immersing disc films into each of treatment liquid baths and removing them therefrom and forward movement for displacing the disc films to the next treatment liquid bath are achieved there has been already made a proposal which is granted as patent under U.S. Pat. No. 4,502,772, British Pat. No. 2,122,771B and Canadian Pat. No. 1,191,732. The conventional transporting apparatus is constructed such that it includes a movable rail adapted to slidably carry a plurality of hangers thereon and repeatedly carry out a series of movements comprising upward movement, forward movement, lowering movement, backward movement and temporary stoppage at the lowermost position of the movable rail which is provided with endless chains extending around sprocket wheels at both the foremost and rearmost ends as seen in the direction of arrangement of a series of treatment liquid baths, each of the hangers being provided with a support shaft at the lower end thereof on which a plurality of disc films to be treated are rotatably supported, and a plurality of hanger displacement preventing members for preventing forward movement and backward movement of the hangers at time a little bit before the movable rail reaches the lowermost position, each of the hanger displacement preventing members being equipped with a rotational force transmitting mechanism by way of which rotational force is transmitted to the support shaft for the disc films, wherein required treatment is carried out during temporary stoppage of the movable rail while the support shaft is rotated in each of the treatment liquid baths together with disc films and thereafter the hanger is caused to advance by a distance of one section during upward movement, forward movement and lowering movement of the hanger. However, it has been pointed out as drawbacks inherent to the above-mentioned conventional transporting apparatus that in spite of the fact that each of the disc films is designed in smaller dimensions as an article to be treated, the movable rail adapted to carry outward upward movement and lowering movement together with the hangers is unavoidably forced to have a wide range of movement and thereby components and parts constituting the transporting apparatus as designed in larger dimensions, resulting in increased number of components and parts, complicated structure and function and reduced economical efficiency.

SUMMARY OF THE INVENTION

Hence, the present invention has been made with the foregoing background in mind and its object resides in providing an improved apparatus for transporting disc films which assures that a series of developing steps are carried out for disc films at a high operative efficiency in spite of the fact that a quantity of consumption of disc films is still maintained at a lower level compared with a total quantity of consumption of whole photographic materials available in commercial market, although there is seen a tendency of appreciable increase in quantity of consumption of disc films.

Other objected of the present invention is to provide an improved apparatus for transporting disc films which assures that it is designed and constructed in smaller dimensions in order to fit a treating apparatus adapted to treat small-sized disc films of which quantity of consumption is maintained at a lower level.

Another object of the present invention is to provide an improved apparatus for transporting disc films which assures that it is easy to be assembled in a treating apparatus for disc films and operated very smoothly and moreover it can be manufactured at an inexpensive cost.

To accomplish the above objects there is proposed according to the present invention an apparatus for transporting disc films in a developing apparatus wherein the improvement consists in that a movable rail which carries a plurality of hangers is supported by means of a support block which is slidable along a shaft which extends in parallel with the direction of transportation of the hangers and is adapted to turn about the shaft, each of the hangers being provided with a rotational shaft at the lower end thereof for rotatably supporting a plurality of disc films to be treated, and being adapted to slide along the movable rail, that the support block is operatively connected to a moving member by way of a connecting rod, the moving member being driven by means of a chain-sprocket mechanism which serves to achieve upward movement, lowering movement, forward movement and backward movement of the moving member in such a manner that the disc films carried by the hangers is introduced into the treatment liquid bath and raised up from the latter by turning the support block in the forward direction and then turning it in the backward direction with the aid of the connecting rod during upward movement and lowering movement of the moving member and the hanger is slidably displaced to the next operative position located above the next treatment bath during forward movement of the moving member while the disc films are raised up above the treatment liquid bath, and that a plurality of stoppers are disposed in the spaced relation along the movable rail in order to assure that only the movable rail moves backwardly during backward movement of the moving member while the disc films are immersed in treatment liquid in the next treatment liquid bath.

Other object, features and advantages of the present invention will become readily apparent from reading of the following description which has been prepared in conjunction with the accompanying drawings.

BRIEF DESCRIPTION OF THE DRAWINGS

The accompanying drawings schematically illustrate how the apparatus of the present invention which is incorporated in a disc film developing apparatus is operated in association with a series of treatment liquid baths but insignificant components and parts which are well known for any expert in the art are shown in the possibly simple manner or they are not shown for the purpose of simplification of illustration. Now, the accompanying drawings will be briefly described below.

DESCRIPTION OF THE PREFERRED EMBODIMENT

Figure 1:
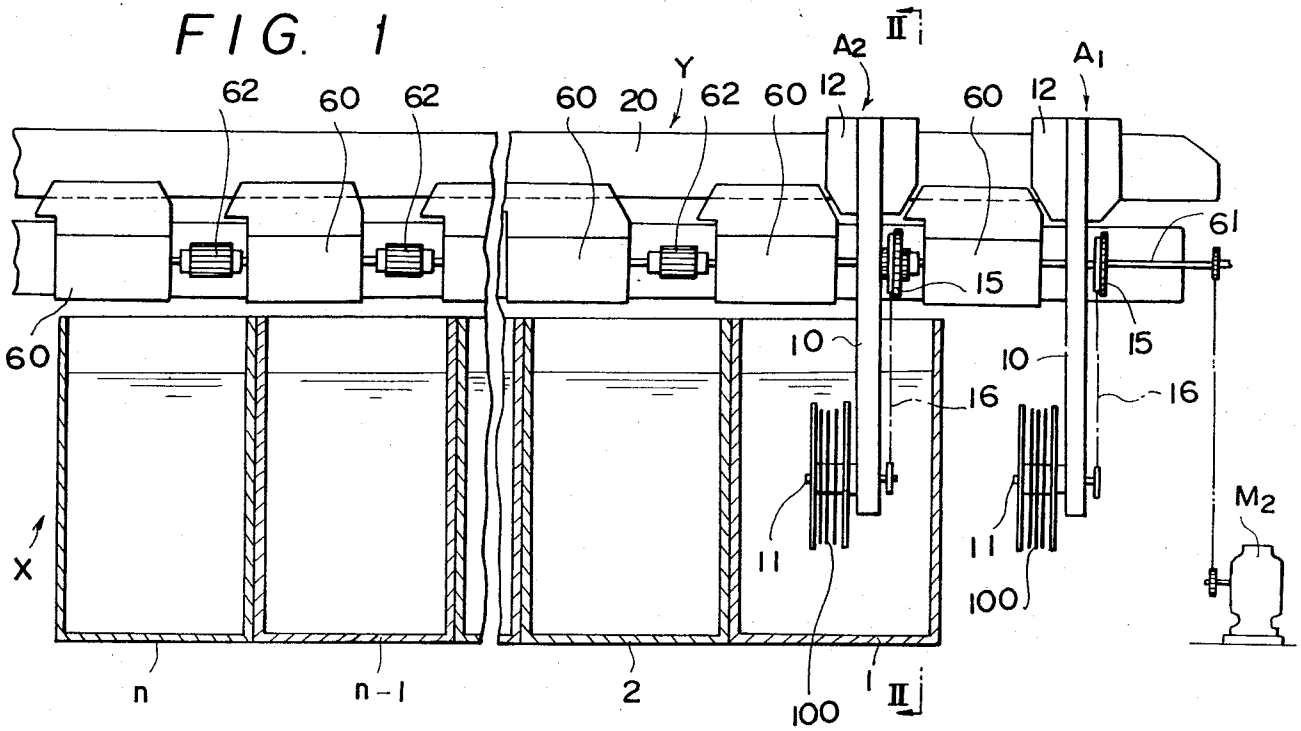
FIG. 1 is a schematic sectional front view of the developing apparatus, particularly illustrating that hangers having a plurality of disc films carried thereon are transported stepwise with the aid of the apparatus of the present invention, wherein the one hanger is immersed in a treatment liquid bath.

Now, the present invention will be described in a greater detail hereunder with reference to the accompanying drawings which schematically illustrate an apparatus for transporting disc films in accordance with an embodiment of the present invention.

It should be noted that for the purpose of simplification of illustration insignificant components constituting the apparatus of the present invention which are well known for any expert in the art are not shown in the drawings.

Referring first to FIG. 1, reference numeral 100 designates a circular disc-shaped photographic film that is called disc film of which outer diameter is determined to about 6.5 cm (2.56 inch), of which central part is formed with a fitting hole having an inner diameter of about 1 cm (0.4 inch) and which has a plurality of exposure portions arranged in the equally spaced relation along the outer periphery thereof, reference letter X does a treatment liquid bath section including a plurality of treatment liquid baths 1, 2, 3–n in which a series of developing treatment steps comprising developing, bleaching, fixing and film stabilizing and hardening are carried out for the disc films 100 with a step of water washing interposed between the adjacent steps as required and reference letter Y does an apparatus for transporting films according to the present invention to be described later in more details so as to achieve the aforesaid developing treatment steps in the treatment liquid bath section X. A disc film developing apparatus constituted by the combination of the treatment liquid bath section X and the transportation apparatus Y is intended to constitute also a dark box which is not shown in the drawings and it has a frame as essential component which is designed and constructed in the well known manner with a control box mounted thereon. Obviously, the control box includes a number of switches and push buttons for controlling start and stop of the apparatus.

Next, the transportation apparatus Y for carrying out a series of the above-mentioned steps by successively immersing disc films 100 in the treatment liquid baths 1, 2, 3–n after they ride over the partition between the adjacent baths will be described below in more details particularly with respect to structure and function thereof.

Figure 2:
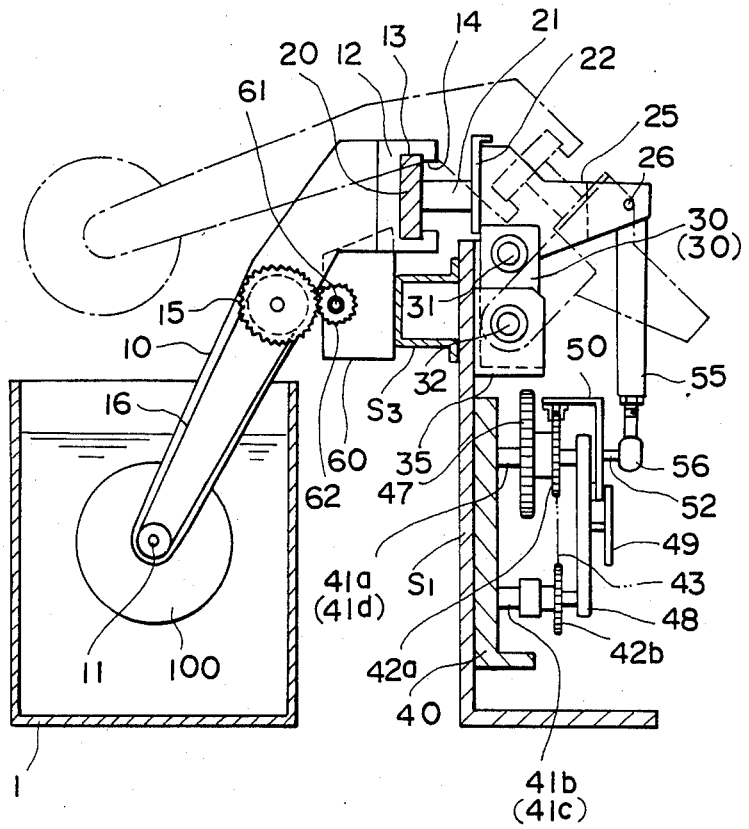
FIG. 2 is a cross-sectional view of the developing apparatus taken in line II—II in FIG. 1, particularly illustrating how the apparatus of the present invention is operated.
Figure 3:
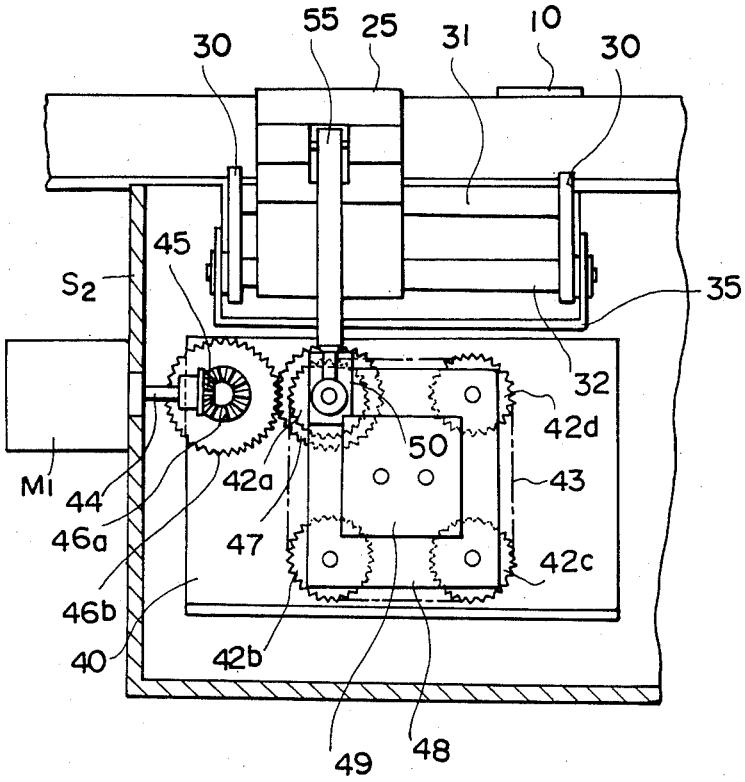
FIG. 3 is a fragmental rear view of the developing apparatus in FIG. 1 as seen from the back side, particularly illustrating how a mechanism for displacing the support block relative to the movable rail is constructed.

As shown in FIGS. 1 to 3, several disc films 100 are supported on a rotational shaft 11 in such a manner that they are inhibited from rotating unintentionally. As will be apparent from the drawings, the rotational shaft 11 is rotatably mounted on the foremost end part of a hanger 10. The base portion 12 of the hanger 10 is formed with a rectangular sliding slit 13 through which a movable rail 20 is fitted and a groove 14 through which a movable rail support rod 21 is inserted. As will be described later, the movable rail 20 is disposed in the horizontal posture in the direction of arrangement of the treatment liquid baths 1, 2, 3–n at the position located backwardly and appreciably upwardly of the treatment liquid baths 1, 2, 3–n. The support rod 21 is attached to a rail holding plate 22 which is immovably held at the position in the proximity of both the ends of the movable rail 20. By virtue of the arrangement made for the base portion 12 of the hanger 10 the latter is supported on the movable rail 20.

Further, reference numeral 25 designates a support block carried on the rail holding plate 22 of which position is determined adjustably. The support block 25 is formed with two through holes extending in parallel with the movable rail 20 at the upper and lower parts thereof and moreover it is provided with a shaft 26 for pivotally holding the upper end of a connecting rod 55 which will be described later.

Shafts 31 and 32 extending between both brackets 30 are fitted through the holes which are formed in the upper and lower parts of the support block 25 in parallel with the movable rail 20 whereby the support block 25 is supported slidable along the shafts 31 and 32.

Since the lower shaft 31 is pivotally supported on a frame 35 at both the ends thereof while the frame is fixedly secured to the side wall $S_1$ which extends in parallel with the direction of arrangement of the treatment liquid baths 1, 2, 3–n, it serves as a rotational shaft adapted to rotatably support the brackets 30 together with the support block 25.

Specifically, the support block 25 which supports the movable rail 20 via the rail holding plate 22 is adapted to slide in the horizontal direction along the shafts 31 and 32 extending between both the brackets 30 and moreover it is adapted to turn about the shaft 32 together with the brackets 30.

Next, description will be made below as to a mechanism for carrying out sliding movement as well as turning movement of the support block 25.

A board 40 fixedly secured to the side wall $S_1$ has four shafts 41*a*, 41*b*, 41*c* and 41*d* projected therefrom in the horizontal direction of which position is located at each of four corners of a square and four sprocket wheels $42_a$, $42_b$, $42_c$ and $42_d$ are rotatably mounted on the shafts $41_a$, $41_b$, $41_c$ and $41_d$ while an endless chain 43 extends around the sprocket wheels $42_a$, $42_b$, $42_c$ and $42_d$. Arrangement is so made that rotational force of a motor $M_1$ fixedly mounted on the side wall $S_2$ which is located at a right angle relative to the side wall $S_1$ is transmitted to the sprocket wheel $42_a$ via a bevel gear 45 mounted on the output shaft 44 of the motor $M_1$, a bevel gear $46_a$ meshing with the bevel gear 45, a gear $46_b$ made integral with the bevel gear $46_a$ in the coaxial relation and a gear 47 made integral with the sprocket wheel $42_a$ in the coaxial relation to mesh with the gear $46_b$.

Figure 4:
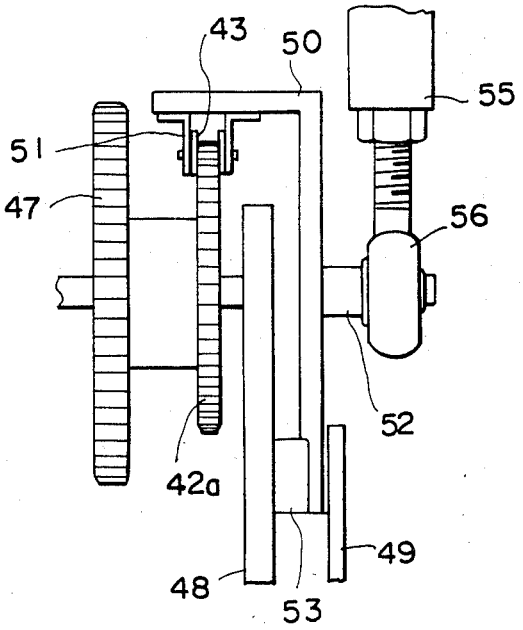
FIG. 4 is an enlarged side view of the mechanism in FIG. 2, particularly illustrating how a moving member is incorporated in the mechanism.
Figure 5:
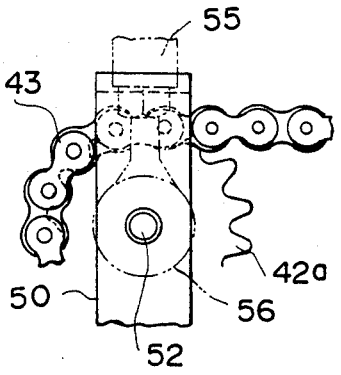
FIG. 5 is a fragmental view of the mechanism in FIG. 3, particularly illustrating how the connecting rod is operatively connected to the moving member and the latter is jointed to an endless chain which extends around a sprocket wheel.

As will be best seen from FIG. 4 which is an enlarged side view, a moving member 50 fixedly secured to the chain 43 is made of plate material in the inverted L-shaped configuration and it is secured to the chain 43 with the use of chain attachments 51 which are bolted to the horizontal portion of the moving member 50. A joint pin 52 projected in the horizontal direction from the vertical portion of the moving member 50 is operatively connected to the lower end of the connecting rod 55 with the aid of a ball joint 56 while the upper end of the connecting rod 55 is pivotally jointed to the shaft 26 of the support block 25.

Incidentally, the position of the joint pin 52 is so determined that its axis is located in alignment with each of the axes of the sprocket wheels $42_a$, $42_b$, $42_c$ and $42_d$ when the moving member 50 reaches the position where it turns about each of the sprocket wheels $42_a$, $42_b$, $42_c$ and $42_d$. Further, a support plate 48 is attached to the foremost end of the shafts $41_a$, $41_b$, $41_c$ and $41_d$ on which the sprocket wheels $42_a$, $42_b$, $42_c$ $42_d$ are rotatably supported. The support plate 48 is provided with a position determining plate 49 in such a manner that a guide piece 53 disposed at the lowermost end of the vertical portion of the moving member 50 is located between the support plate 48 and the position determining plate 49.

On the other hand, a support frame $S_3$ fixedly secured to the side wall $S_1$ in parallel with the movable rail 20 is provided with a plurality of stoppers 60 each of which inhibits the hanger 10 from moving backwardly, wherein two stoppers 60 are located at the outer ends of the treatment liquid baths 1 and n respectively and other ones are located between the adjacent treatment liquids baths 1, 2, 3–n. As shown in FIG. 1, the stoppers 60 serve as supporting member for rotatably supporting a rotational shaft 61 which is driven by means of a motor $M_2$. A gear 62 is fixedly mounted on the rotational shaft 61 at the position between the adjacent stoppers 60 in such a manner that it meshes with a driving gear 15 which serves to drive an endless driving belt 16 for rotating the rotational shaft 11 on the hanger 10 on which a plurality of disc films 100 are supported.

Next, description will be made below as to how developing treatment is carried out for the disc films 100. First, the hanger 10 having several disc films 100 mounted on the rotational shaft 11 is placed on the movable rail 20 at the position as identified by reference letter $A_1$ in FIG. 1. Then, the chain 43 is driven by operating the motor $M_1$, while the rotational shaft 61 is driven by rotating the motor $M_2$. When it is assumed that the moving member 50 is located at the position as shown in FIG. 3, it turns about the sprocket wheel $42_a$ by an angle of 90 degrees and thereafter it starts lowering movement. As it is lowered, the connecting rod 55 is caused to descend together with the moving member 50 whereby the support block 25 turns about the shaft 32 together with the brackets 30 until the hanger 10 is raised up above the treatment liquid baths 1, 2, 3–n with the aid of the movable rail 20 as represented by phantom lines in FIG. 2.

During turning movement of the moving member 50 about the sprocket wheel $42_b$ by an angle of 90 degrees the movable rail 20 and the hanger 10 are kept immovable. When the moving member 50 starts movement in the horizontal direction toward the sprocket wheel $42_c$, movement of the moving member 50 is transmitted to the support block 25 via the connecting rod 55 so as to allow the support block 25 to slide on the shafts 31 and 32 whereby the movable rail 20 is caused to advance because it is jointed to the support block 25. As a result, the hanger 10 is displaced to the position $A_2$ above the treatment liquid bath 1.

Next, during turning movement of the moving member 50 about the sprocket wheel $42_c$ by an angle of 90 degrees the movable rail 20 and the hanger 10 are kept immovable. When the moving member 50 starts movement in the upward direction toward the sprocket wheel $42_d$, movement of the moving member 50 is transmitted to the movable rail 20 via the connecting rod 55 whereby the hanger 10 is caused to turn together with the movable rail 20 in the direction of immersion of the hanger 10 into the treatment liquid bath 1. When the moving member 50 reaches the sprocket wheel $42_d$ after it has achieved its movement in that way, the hanger 10 is held in the treatment liquid bath 1 in the immersed state. At this moment the gear 62 is brought in meshing engagement with the gear 15 and thereby the endless belt 16 is driven to rotate the disc films 100. Thus, developing treatment in the treatment liquid bath 1 is carried out. At this moment the hanger 10 is located between the adjacent stoppers 60.

During turning movement of the moving member 50 about the sprocket wheel $42_d$ by an angle of 90 degrees the movable rail 20 and the hanger 10 are kept immovable. Thereafter, as the moving member 50 moves toward the sprocket wheel $42_a$, the connecting member 55 is caused to move backwardly together with the movable rail 20 but the hanger 10 is held in the treatment liquid bath 1 in the immersed state because of inhibitive function of the stoppers 60. The immersed state as mentioned above continues until the moving member 50 starts its lowering movement away from the sprocket wheel $42_a$.

As the moving member 50 is lowered, the hanger 10 is caused to turn in the direction away from the treatment liquid bath 1 until it is disengaged from the stoppers 60. Thereafter, a series of movements as mentioned above are repeated and thereby the disc films 100 are successively immersed in the treatment liquid baths 2, 3–n by way of turning movements of the hanger 10. As a result, intended developing treatment is completed.

In the case where treatment for the disc films 100 fails to be achieved for a period of time as measured between the time when the moving member 50 reaches the sprocket wheel $42_d$ and the time when it leaves the sprocket wheel $42_a$, the motor $M_1$ is required to stop its operation.

Since the support block 25 has an inoperative period of time prior to starting its upward movement, lowering movement, forward movement and backward movement corresponding to the radius of the sprocket wheels $42_a$, $42_b$, $42_c$ and $42_d$, controlling for movements of the support block 25 can be effected very smoothly.

Further, since movement of the hanger 10 during a series of developing steps for the disc films 100 is limited to the minimized extent of turning movement about the shaft 32 plus horizontal linear movement along the shafts 31 and 32, space required for carrying out movements of the hanger 10 in the treatment apparatus can be reduced. This leads to an advantageous feature that the whole apparatus can be designed and constructed in smaller dimensions in the compact structure. Furthermore, since the support block 25 is fitted to the movable rail 20 with the use of the rail holding plate 22 of which position is determined adjustably, it is assured that the movable rail 20 assumes the optimum position for the hanger 10.

As will be readily apparent from the above description, characterizing features of the present invention consist in that introduction of hanger into treatment liquid bath and removal of the former from latter can be achieved within the minimized operative extent merely by turning movement of the hanger about one of two shafts along which the support block is adapted to slide together with the hanger having a plurality of disc films carried thereon and thereby the whole apparatus can be designed and constructed in smaller dimensions and moreover the movable rail can be located at the optimum position for the hanger because the support block is fitted to the movable rail with the aid of a rail holding plate of which position is determined adjustably.

While the present invention has been described above only with respect to a single preferred embodiment, it should of course be understood that it should not be limited only to this but various changes or modifications may be made in any acceptable manner without departure from the spirit and scope of the present invention as defined by the appended claims.

What is claimed is:

1. In an apparatus for transporting disc films, said apparatus being incorporated in a developing apparatus which includes a series of treatment liquid baths, the improvement consisting in;

that a movable rail which carries a plurality of hangers is supported by means of a support block which is slidable along a shaft which extends in parallel with the direction of transportation of said hangers and is adapted to turn about said shaft, each of the hangers being provided with a rotational shaft at the lower end thereof for rotatably supporting a plurality of disc films to be treated, and being adapted to slide along said movable rail, that the support block is operatively connected to a moving member by way of a connecting rod, said moving member being driven by means of a chain-sprocket mechanism which serves to achieve upward movement, lowering movement, forward movement and backward movement of the moving member in such a manner that the disc films carried by the hanger is introduced into the treatment liquid bath and raised up from the latter by turning the support block in the forward direction and then turning it in the backward direction with the aid of the connecting rod during upward movement and lowering movement of the moving member and the hanger is slidably displaced to the next operative position located above the next treatment liquid bath during forward movement of the moving member while the disc films are raised up above the treatment liquid bath, and that a plurality of stoppers are disposed in the spaced relation along the movable rail in order to assure that only the movable rail moves backwardly during backward movement of the moving member while the disc films are immersed in treatment liquid in the next treatment liquid bath.

2. An apparatus as defined in claim 1, wherein the movable rail is supported by means of the support block with the use of a rail holding plate of which position is determined adjustably, said rail holding plate including a rail support rod which is fixedly secured to the movable rail.

3. An apparatus as defined in claim 1, wherein the support block is formed with two through holes at the upper and lower parts thereof which extend in parallel with the movable rail and moreover it is provided with a shaft to which the connecting rod is pivotally connected, said through holes being fitted with each of shafts which extend between brackes so as to allow the support block to slide along said shafts of which both ends are fixedly secured to said brackets.

4. An apparatus as defined in claim 3, wherein the brackets are turnably supported on a frame which is fixedly attached to a casing wall extending in parallel with the direction of arrangement of the treatment liquid baths while both the ends of the lower shaft are fixedly secured to the brackets whereby the support block is adapted to turn about the lower shaft.

5. An apparatus as defined in claim 1, wherein said chain-sprocket mechanism comprises four sprocket wheels rotatably mounted on four shafts which are projected in the horizontal direction from the casing wall at the position at the four corners of a square and an endless chain extending around said sprocket wheels, one of the four sprocket wheels being integrally provided with a gear in the coaxial relation by way of which rotational force of a motor is transmitted to the sprocket wheel.

6. An apparatus as defined in claim 1, wherein the moving member is made of plate material having the inverted L-shaped configuration and includes a horizontal portion and a vertical portion, said horizontal portion being fitted with chain attachments by means of which the moving member is operatively connected to the chain and said vertical portion being fitted with a connecting pin by means of which the moving member is operatively connected to the lower end of the connecting member by way of a ball joint.

7. An apparatus as defined in claim 6, wherein said connecting pin projected from the vertical portion of the moving member is located in alingment with the axis of each of the four sprocket wheels when it reaches there.

8. An apparatus as defined in claim 6, wherein the vertical portion of the moving member is equipped with a guide piece at the lowermost free end thereof which is located between the support plate and the position determining plate.

9. An apparatus as defined in claim 1, wherein each of the stoppers is designed in the form of a support member by means of which a rotational shaft is rotatably supported, said rotational shaft being provided with a plurality of gears which are disposed in the substantially equally spaced relation along the rotational shaft so as to transmit rotational force to the rotational shaft on the hanger with a plurality of disc films carried thereon when the hanger is lowered and thereby the disc films are immersed in treatment liquid in each of the treatment liquid baths.

* * * * *